United States Patent [19]

McKay

[11] Patent Number: 5,070,838

[45] Date of Patent: Dec. 10, 1991

[54] INTEGRATED IDLE AIR AND EXHAUST GAS RECIRCULATION SYSTEM

[75] Inventor: Daniel L. McKay, Rochester, N.Y.

[73] Assignee: General Motors Corporation, Detroit, Mich.

[21] Appl. No.: 653,093

[22] Filed: Feb. 8, 1991

[51] Int. Cl.[5] ..... F02M 3/00

[52] U.S. Cl. ..... 123/339; 123/568

[58] Field of Search ..... 123/568, 339, 569, 571, 123/572, 339, 52 MC, 52 MF; 251/65, 129.10, 129.11

[56] References Cited

U.S. PATENT DOCUMENTS 4,805,582 2/1989 Braun et al. ..... 123/568
4,870,944 10/1989 Matsumoto et al. ..... 123/339
4,875,455 10/1989 Hashimoto et al. ..... 123/568
4,913,114 4/1990 Kauppke et al. ..... 123/339
4,961,413 10/1990 Grey et al. ..... 123/571
4,991,547 2/1991 Davis et al. ..... 123/52 MF
5,003,933 4/1991 Rush, II et al. ..... 123/52 MC

*Primary Examiner*—Raymond A. Nelli
*Attorney, Agent, or Firm*—Karl F. Barr, Jr.

[57] ABSTRACT

An integrated idle bypass air and exhaust gas recirculation control system having a single valve assembly to control both idle air and exhaust gas being supplied to the engine. The valve assembly has a solenoid actuated two-way valve for switching from air to exhaust gas as a source, and a metering valve for controlling the quantity of gas, either idle air or exhaust gas, allowed to enter the engine intake.

3 Claims, 2 Drawing Sheets

INTEGRATED IDLE AIR AND EXHAUST GAS RECIRCULATION SYSTEM

BACKGROUND OF THE INVENTION

1. Field of the Invention

The present invention relates to the supply of idle bypass air and exhaust gas to the intake manifold of an internal combustion engine and, more particularly, to an integrated idle air and exhaust gas recirculation supply system having a control valve assembly for control of both idle air and exhaust gas.

2. Description of the Relevant Art

Typical automotive internal combustion engines utilize an idle air bypass system for the control or stabilization of engine speed during idle operation. Such a system may have an electrically operated valve assembly which modulates the air passing through a conduit which bridges the throttle plate of the air intake to the engine. The valve assembly may be controlled by the engine control module or other suitable controller which is capable of monitoring predetermined engine parameters which are affected by load changes requiring a change in engine speed.

In addition to the idle air bypass system, the advent of various emission control schemes for meeting regulatory requirements has necessitated the use of recirculated exhaust gas for controlling temperatures in the combustion chamber of the engine. The control of exhaust gas quantities fed to the engine intake may be achieved through the use of an electrically operated exhaust gas recirculation (EGR) valve which is controlled by the engine control module or other suitable controller capable of responding to information regarding various predetermined engine parameters received from sensors disposed throughout the engine, intake and exhaust systems of the engine.

In most cases, idle air and EGR operate exclusive of one another. That is, idle air and EGR rarely are required to be supplied to the engine at the same time since EGR is operational at off-idle throttle position and idle air control (IAC) is functional primarily during idle operation.

SUMMARY OF THE PRESENT INVENTION

The present invention discloses the use of an integrated IAC/EGR control system which utilizes a single valve assembly to control both idle air and exhaust gas supplied to the intake side of the engine. The valve assembly has a solenoid actuated two-way valve which selects air or exhaust gas supplied by conduits connecting the valve assembly with an air source and an exhaust gas source. A metering valve is used to control the quantity of gas, either idle bypass air or recirculated exhaust gas, allowed to enter the intake.

In a preferred embodiment of the system, the valve assembly comprises features of the exhaust gas recirculation valve assembly disclosed in U.S. Pat. No. 4,961,413, issued Oct. 9, 1990, to Grey et al., and assigned to the assignee of the present invention.

The valve assemblies act in conjunction with a common base to collect and distribute the idle air and exhaust gas to the engine intake through a system of supply conduits. Both the solenoid actuated two-way valve and the metering valve may be controlled by the engine electronic control module which issues instructions in response to information gathered from sensors which monitor various engine and exhaust system parameters.

The integrated IAC/EGR control system disclosed herein eliminates the need for using two control valves and associated conduits required to support two fully independent systems. Reduction in the number of components from the IAC and EGR systems by integrating them into a single integrated system reduces complexity thereby improving the potential for reliable operation and reducing overall cost.

DESCRIPTION OF THE PREFERRED EMBODIMENT

Figure 1:
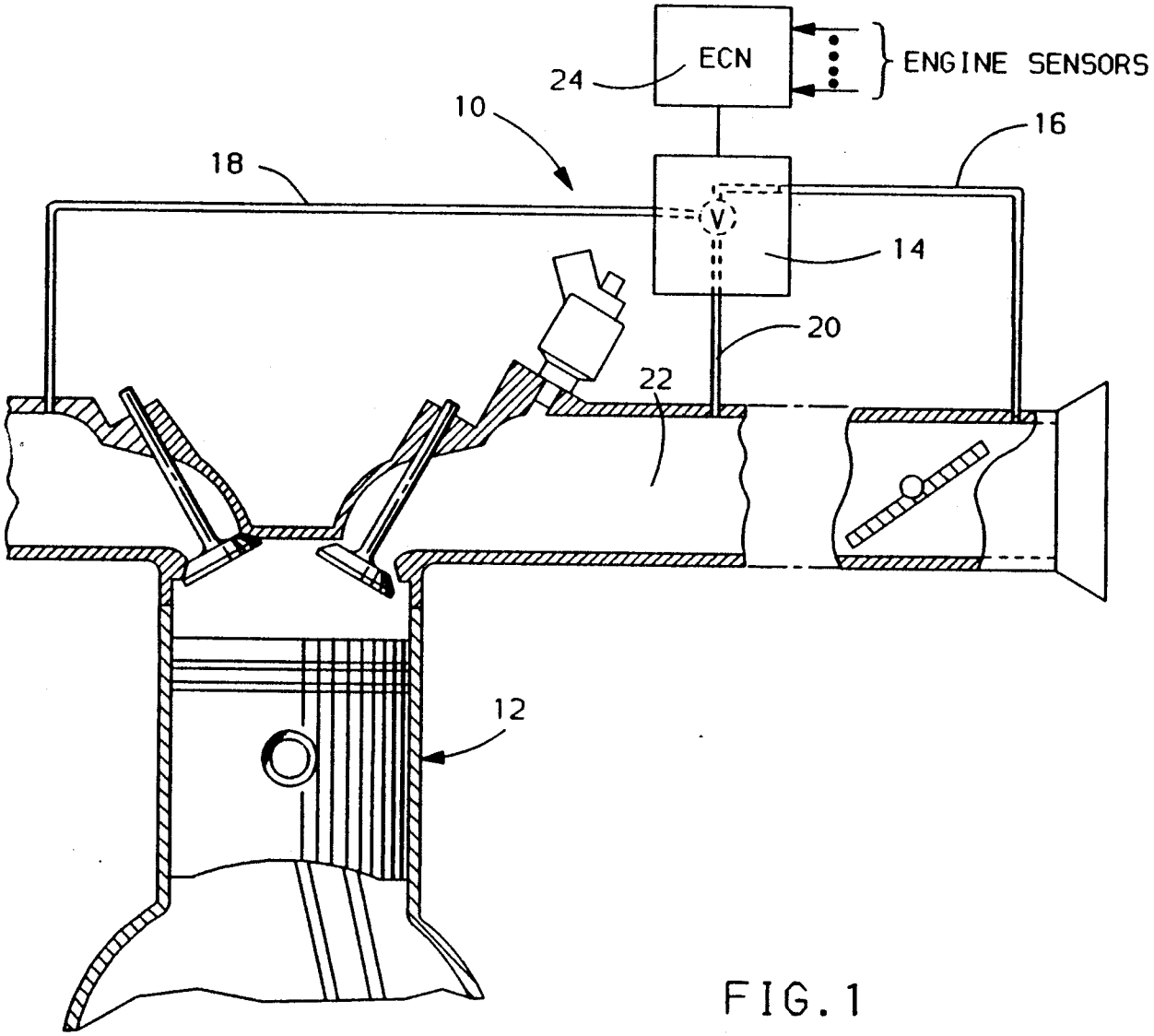
FIG. 1 is a schematic view of the system presently disclosed, applied to an internal combustion engine.

In FIG. 1 there is shown a schematic view of an integrated idle bypass air and exhaust gas recirculation control system (IAC/EGR) 10 installed on an internal combustion engine 12. The system comprises a control valve assembly 14 to which idle air and exhaust gas supply conduits 16 and 18, respectively, are attached. Intake supply conduit 20 conducts idle air and exhaust gas from the valve assembly 14 to the intake 22 of engine 12.

Disposed within control valve assembly 14 are valve means (discussed in further detail below) which are operable to supply idle bypass air or recirculated exhaust gas to the engine 12 based on instructions from a controller, such as Engine Control Module (ECM) 24. The controller monitors predetermined engine parameters using information gathered from various engine, intake and exhaust sensors which monitor variables, such as engine speed and load which can be determined from manifold pressure, air flow, throttle position, coolant temperature and exhaust oxygen sensor readings, or a combination of these. The controller determines whether idle air or recirculated exhaust gas is required, the necessary volume, and adjusts the valve means within the control valve assembly 14 accordingly. A position sensor within the valve assembly allows the ECM 24 to monitor the volume of idle air or exhaust gas being supplied, based on predetermined flow characteristics of the valve, thereby allowing adjustment of flow if necessary.

Figure 2:
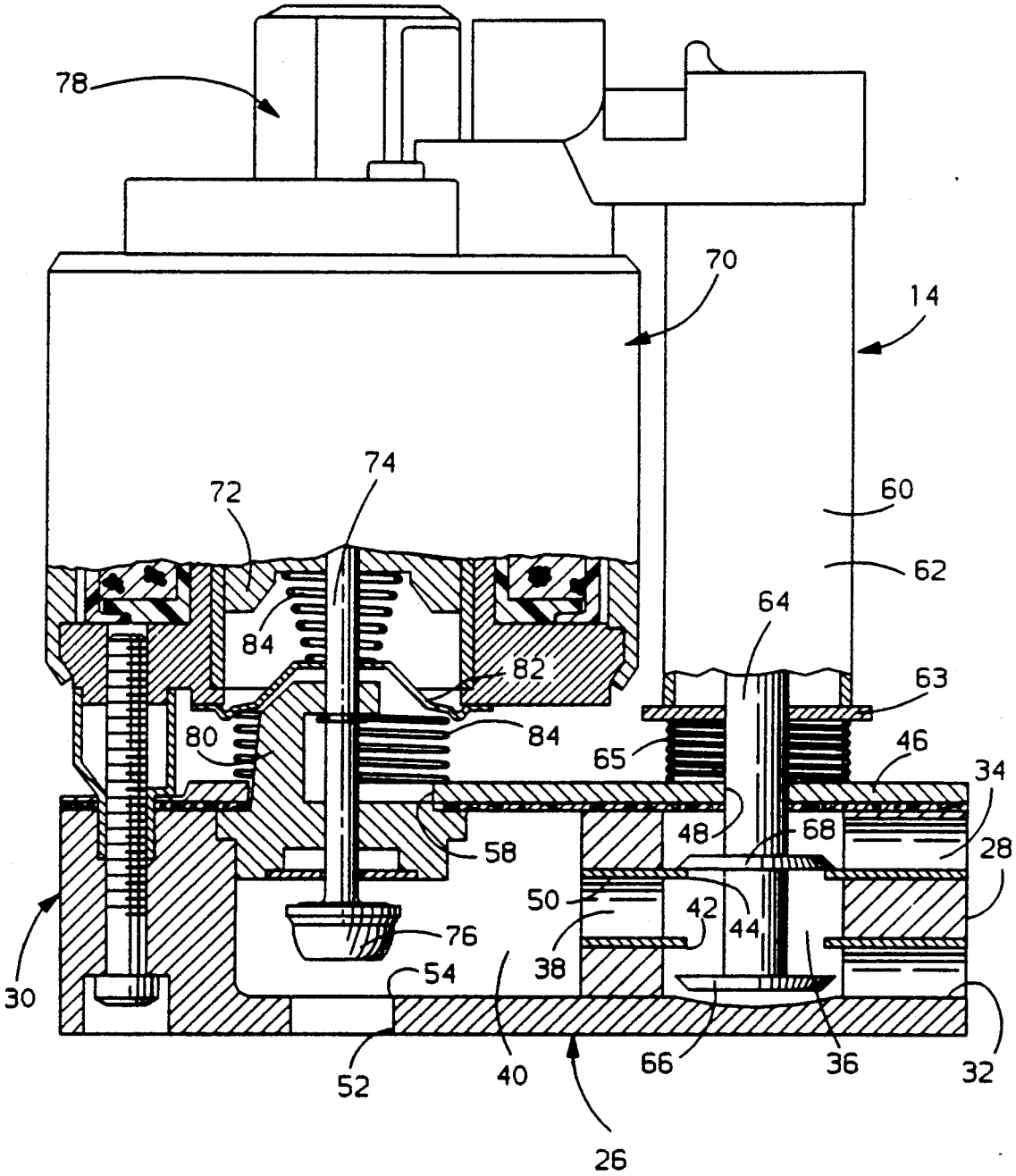
FIG. 2 is a side view, partially in section, of a control valve assembly of the present invention.

Turning to FIG. 2, control valve assembly 14 is shown in greater detail. The assembly comprises a base 26 having an inlet end 28 and an outlet end 30. The inlet end 28 has first and second inlets 32 and 34 which cooperate with idle air and exhaust gas conduits 16 and 18, respectively. An open-top valve chamber 36 extends between, and fluidly connects, inlets 32 and 34. Additionally, the valve chamber is fluidly connected, via connecting conduit 38, with central chamber 40 of outlet end 30. First and second inlet valve seats 42 and 44 are positioned between inlet openings 32 and 34 and valve chamber 36. The valve seats have a common central axis which extends out of the open valve chamber 36. Cover 46 sealingly closes chamber 36 and has an opening 48 which is in general alignment with the valve seats 42 and 44.

The outlet end 30 of valve assembly 14 has an opened top central chamber 40 with an inlet opening 50 integral with connecting conduit 38, and an outlet opening 52 cooperating with intake supply conduit 20 to supply idle air or exhaust gas to intake 22. A valve seat 54 surrounds outlet opening 52 and has a central axis extending outwardly of the open top of chamber 40. Cover 46 also acts to sealingly close the chamber 40 and has a second opening 58 which is in general alignment with valve seat 54.

Mounted to the outer surface of cover 46 is a solenoid valve assembly 60 comprising actuator 62 having a reciprocably movable armature (not shown) disposed therein. Fixedly attached to the armature and extending outwardly therefrom is valve stem 64. The valve stem 64 passes through opening 48 in cover 46 to terminate within valve chamber 36 for reciprocable movement therein. To prevent intrusion of dirt and moisture into the actuator 62, seal member 63 is disposed between actuator 62 and cover 46. Biasing means, such as compression spring 65, maintains seal 63 in positive engagement with the lower portion of the actuator.

Valve head 66 is disposed at the terminal end of valve stem 64, and is configured to engage first valve seat 42 when the actuator has placed the valve stem in the retracted position. In this position, idle air supply from conduit 16 is blocked entry to valve chamber 36. A second valve head 68 is located at an axially inward position along valve stem 64 and is configured to engage second valve seat 44 when the actuator has placed the valve stem in the extended position. In this position, exhaust gas supply from conduit 18 is blocked access to valve chamber 36, while idle air enters through opened valve seat 42. In the above manner, the solenoid valve can be used to selectively choose between supplying idle bypass air or exhaust gas to central chamber 40, and subsequently to intake 22.

In an alternative embodiment, should both idle air and exhaust gas be desired, an intermediate setting can be obtained wherein the solenoid places both valves 66 and 68 in a partially opened position allowing both supplies to remain opened to the valve chamber 36. A check valve (not shown) would be required within idle air source conduit 16 to prevent entry of exhaust gas caused by pressure differentials between the two supply conduits 16 and 18.

Mounted to the upper surface of cover 46, adjacent solenoid valve assembly 60, is linear solenoid actuator 70. The actuator has a reciprocably movable armature 72 disposed therein. Fixedly attached to the armature and extending outwardly therefrom is valve stem 74. The valve stem 74 passes through opening 58 in cover 46 to terminate within central chamber 40 for reciprocable movement therein.

Valve head 76 is disposed at the terminal end of stem 74, and is configured to engage valve seat 54 of opening 52 when the actuator is in an extended position. By varying the position of valve head 76 relative to seat 54, the volume of idle air or exhaust gas supplied to engine intake 22 can be controlled. A position sensor 78 monitors the location of valve stem 74, thereby providing feedback information to ECM 24 regarding flow rates through valve assembly 14.

In order to assure precise metering of gas flow through opening 52, valve stem 74 and its corresponding valve head 76 must be precisely aligned with valve seat 54. Bearing member 80, is provided within cover opening 58, to support valve stem 74 and assure precise alignment. To prevent intrusion of dirt and moisture into the actuator 70, seal member 82 is disposed between actuator 70 and cover 46. Biasing means, such as compression spring 84, maintains seal member 82 in positive engagement with the lower portion of the actuator.

It is desirable to assure supply of idle air when power is shut off, or in cases of valve failure, in order to prevent stalls at idle. Biasing means, such as compression spring 84, is disposed within actuator 70 and acts to bias the armature 72 to a predetermined retracted position during power-off events, thereby retracting valve 76 from seat 54 to supply a predetermined quantity of idle air to intake 22. In a similar manner, actuator 62 of solenoid valve assembly 60 has a means for biasing valve stem 64, such as a spring (not shown), into an extended position during power-off events to assure the supply of idle air to chamber 40.

In operation, the ECM 24 monitors predetermined engine parameters using information gathered from various engine, intake and exhaust sensors which monitor variables, such as engine speed, manifold pressure, intake air flow, throttle position, coolant temperature and exhaust oxygen content. In response to the above information, the ECM 24 signals actuator 62 of solenoid valve assembly 60 to extend or retract, thereby supplying idle bypass air or recirculated exhaust gas. Simultaneously, ECM 24 signals actuator 70 to position itself according to the determined quantity of idle bypass air or exhaust gas required. Based on feedback information received from position sensor 78, ECM 24 is able to modify the position of the valve 76 to achieve the desired flow rate.

The integrated idle air and exhaust gas recirculation supply system of the present invention provides an alternative to the use of two fully independent systems for the control of idle air and exhaust gas recirculation. By integrating the two systems into a single integrated system, complexity is reduced thereby improving the potential for reliable operation and reducing overall cost.

The embodiments of the invention in which an exclusive property or privilege is claimed are defined as follows:

1. An integrated idle air and exhaust gas recirculation control system for use on an internal combustion engine comprising:

a control valve assembly comprising a base having a central chamber therein and inlet means for the introduction of idle air and exhaust gas to said central chamber and an outlet opening for the supply of said idle air and exhaust gas to the engine;

first and second source conduits in communication with said central chamber for supply of idle air and exhaust gas respectively to said base and an intake supply conduit disposed between said central chamber outlet and the engine for conducting the supply of idle air and exhaust gas thereto;

an electronically controlled two-way valve assembly disposed between said first and second source conduits and said central chamber and movable from a first position in which idle air is supplied to said chamber to a second position in which exhaust gas is supplied to said chamber;

an electronically controlled metering valve operable to meter the flow of idle air and exhaust gas through said central chamber outlet and having position sensing means for determining the position of said valve;

control means operable, in response to predetermined engine parameters, to move said two-way valve between said first and second positions to supply idle air and exhaust gas to the engine; and control means operable, in response to predetermined engine parameters and the position of the metering valve as determined by said position sensor, to position said metering valve to control the quantity of idle air and exhaust gas supplied.

2. An integrated idle air and exhaust gas recirculation control system for use on an internal combustion engine, as defined in claim 1, wherein said two-way valve has a third position in which idle bypass air and exhaust gas are supplied simultaneously.

3. An integrated idle air and exhaust gas recirculation control system for use on an internal combustion engine, as defined in claim 1, wherein said two-way valve has a means for biasing said valve to said first, idle air position, and said metering valve has means for biasing said valve to a predetermined position when power is interrupted from said control means, thereby supplying a predetermined quantity of idle bypass air to the engine.

* * * * *